US009695843B2

(12) United States Patent
Buettner et al.

(10) Patent No.: US 9,695,843 B2
(45) Date of Patent: Jul. 4, 2017

(54) HYDRAULIC LOAD-SENSING CONTROL ARRANGEMENT

(71) Applicant: Robert Bosch GmbH, Stuttgart (DE)

(72) Inventors: Peter Buettner, Lohr (DE); Robert Rueppel, Bischbrunn (DE); Timo Ikonen, Woerth (DE)

(73) Assignee: Robert Bosch GmbH, Stuttgart (DE)

( * ) Notice: Subject to any disclaimer, the term of this patent is extended or adjusted under 35 U.S.C. 154(b) by 291 days.

(21) Appl. No.: 14/382,252

(22) PCT Filed: Feb. 27, 2013

(86) PCT No.: PCT/EP2013/000567

§ 371 (c)(1),
(2) Date: Aug. 29, 2014

(87) PCT Pub. No.: WO2013/127523

PCT Pub. Date: Sep. 6, 2013

(65) Prior Publication Data

US 2015/0013319 A1 Jan. 15, 2015

(30) Foreign Application Priority Data

Mar. 1, 2012 (DE) ..... 10 2012 004 301

(51) Int. Cl.
*F15B 13/02* (2006.01)
*F15B 11/16* (2006.01)

(52) U.S. Cl.
CPC ..... *F15B 13/024* (2013.01); *F15B 11/163* (2013.01); *F15B 2211/20546* (2013.01);
(Continued)

(58) Field of Classification Search
CPC ..... F15B 11/163; F15B 13/026; F15B 2211/20546; F15B 2211/20576;
(Continued)

(56) References Cited

U.S. PATENT DOCUMENTS 5,193,342 A 3/1993 Omberg et al.
6,848,255 B2 * 2/2005 Chiaramonte ..... F01P 7/044 60/456
7,654,337 B2 2/2010 Nöel

FOREIGN PATENT DOCUMENTS

DE 198 55 187 A1 5/2000
DE 199 30 618 A1 1/2001
DE 10 2008 008 101 A1 8/2008

OTHER PUBLICATIONS

Translation of DE 199 30 618 A1, Mannesmann Rexroth AG, Jan. 4, 2001.*

(Continued)

*Primary Examiner* — Logan Kraft
(74) *Attorney, Agent, or Firm* — Maginot, Moore & Beck LLP

(57) ABSTRACT

A hydraulic load-sensing control arrangement for a first and second hydraulic consumer has a variable displacement pump having load-sensing regulation, to which the highest respective load-sensing pressure of consumers is reported. The first consumer has the highest load pressure in normal operation and therefore the highest load-sensing pressure dependent on the load pressure. A pressure reducing valve is arranged in the pressure medium flow path between the variable displacement pump and the first consumer. A spring force from a regulating spring and a regulating pressure dependent on the load pressure of the first consumer are applied in the opening direction of a valve gate in this pressure reducing valve and pressure is applied directly downstream from the pressure reducing valve in the closing direction thereof. A pressure equivalent of the spring force of the regulating spring and the regulating pressure are greater than a pressure of the variable displacement pump.

6 Claims, 2 Drawing Sheets

(52) U.S. Cl.
CPC ..... *F15B 2211/20576* (2013.01); *F15B 2211/253* (2013.01); *F15B 2211/40507* (2013.01); *F15B 2211/40561* (2013.01); *F15B 2211/5756* (2013.01); *F15B 2211/6051* (2013.01); *F15B 2211/6054* (2013.01); *F15B 2211/6055* (2013.01)

(58) Field of Classification Search
CPC ..... F15B 2211/253; F15B 2211/40507; F15B 2211/40561; F15B 2211/5756; F15B 2211/6051; F15B 2211/6054; F15B 2211/6055
See application file for complete search history.

(56) References Cited

OTHER PUBLICATIONS

International Search Report corresponding to PCT Application No. PCT/EP2013/00567, mailed Jun. 14, 2013 (German and English language document) (6 pages).

* cited by examiner

HYDRAULIC LOAD-SENSING CONTROL ARRANGEMENT

This application is a 35 U.S.C. §371 National Stage Application of PCT/EP2013/000567, filed on Feb. 27, 2013, which claims the benefit of priority to Ser. No. DE 10 2012 004 301.5, filed on Mar. 1, 2012, in Germany, the disclosures of which are incorporated herein by reference in their entirety.

The disclosure relates to a hydraulic load sensing control arrangement for a plurality of hydraulic consumers as described herein.

BACKGROUND

U.S. Pat. No. 7,654,337 B2 discloses a control arrangement of this kind. This is used to control a drilling unit having a first hydraulic consumer in the form of a hydraulic hammering device and having a second hydraulic consumer in the form of a hydraulic feed device. The first consumer is connected to a variable displacement pump by a supply line. An electrically actuable selector valve for connecting and disconnecting the first consumer is provided in the supply line. A pressure reducing valve is arranged downstream of the selector valve, between said valve and the first consumer. In this arrangement, a valve body of the pressure reducing valve is acted upon in the open position thereof by a spring force of a valve spring and by a load sensing pressure dependent on the load pressure of the first consumer and is acted upon in the closed position thereof by the pressure downstream of the pressure reducing valve. The load sensing pressure is carried away via a load sensing line between the pressure reducing valve and the first consumer by way of a control oil nozzle. Downstream of the control oil nozzle, the load sensing line with the pressure reducing valve is connected—to subject the valve body to the load sensing pressure—to a pilot valve or pressure limiting valve for limiting the load sensing pressure and to one inlet of a shuttle valve.

A load sensing line of the second consumer is likewise connected to the inlet side of the shuttle valve. On the outlet side, the shuttle valve is connected to a load sensing regulating system of the variable displacement pump, as a result of which the highest load sensing pressure of the consumers is indicated to the load sensing regulating system by means of the shuttle valve. By means of the load sensing regulating system, a pump pressure of the variable displacement pump is matched to the highest load sensing pressure.

A hammering frequency of the first consumer, which is used as a hammering device, is dependent on the pressure prevailing at the consumer, for which reason, if the pump pressure is determined by the load of the second consumer (the feed device), this pump pressure is reduced by means of the pressure reducing valve to ensure that the pressure for the hammering device does not become too high.

With the control oil nozzle and the pilot valve, the pressure reducing valve is a pilot-controlled pressure reducing valve, on the valve body of which only very weak springs normally act. In order to allow a highly dynamic response from the control arrangement, the pump pressure is generally the result of the load sensing pressure together with a comparatively high pump Δp, which is 30 bar for example.

The disadvantage with this solution is that, in normal operation, in which the hammering device (first consumer) is the consumer with the highest load, the pressure reducing valve regulates a pressure corresponding to the difference between the pump Δp and the pressure equivalent of the spring force of the spring. Since the pump Δp, generally 30 bar, is significantly higher than the pressure equivalent of the spring force of the spring, which is 15 bar for example, the valve body of the pressure reducing valve is in a regulating mode between the closed and the open position thereof in normal operation of the control arrangement, and this leads to energy losses by the control arrangement.

Given this situation, it is the underlying object of the disclosure to provide a control arrangement which has extremely low energy losses in normal operation.

This object is achieved by a hydraulic load sensing control arrangement in accordance with the features described herein.

According to the disclosure, a hydraulic load sensing control arrangement has a first and second hydraulic consumer. A respectively highest load sensing pressure, which is dependent on the load pressure of each consumer, is indicated to a load sensing regulating system of a hydraulic pump supplying the consumers, in particular to a variable displacement pump. Provision is made here for the first consumer to have the highest load pressure in normal operation of the control arrangement. A pressure reducing valve is provided in the pressure medium flow path between the hydraulic pump and the first consumer. Said valve has a valve spool which can be subjected in the closing direction thereof to a pressure downstream of the pressure reducing valve and in the opening direction thereof to a regulating pressure dependent on the load pressure of the first consumer and to a spring force of a regulating spring. Here, a pressure equivalent of the spring force together with the regulating pressure is advantageously greater than a pump pressure in normal operation.

This solution has the advantage that the pressure reducing valve is completely open in normal operation, ensuring that energy losses due to the presence of the pressure reducing valve are extremely low here.

The regulating pressure can simply be tapped from the pressure medium flow path between the pressure reducing valve and the first consumer via a control line having a nozzle.

To limit the pump pressure in normal operation, the load sensing pressure of the first consumer is limited by means of a pressure limiting valve or pilot valve.

In an advantageous embodiment of the disclosure, the regulating pressure is the load sensing pressure of the first consumer, which is tapped downstream of the nozzle. This is then a conventional control arrangement, in which the spring force of the regulating spring is then adapted in such a way that, according to the disclosure, a pressure equivalent of the spring force together with the regulating pressure is greater than a pump pressure in normal operation.

The pressure equivalent of the spring force of the spring is preferably greater than a pressure difference between the pump pressure and the highest load sensing pressure of the consumers (=pump Δp). A high pump Δp leads to a highly dynamic response of the control arrangement, for which reason a comparatively large spring, e.g. one having a pressure equivalent close to 30 bar, is used for a high pump Δp.

In another embodiment, a second nozzle is provided downstream of the first nozzle in the control line. Here, the nozzles form a pressure divider, in which case the regulating pressure for the pressure reducing valve is then tapped in the flow path between the nozzles. A pressure downstream of the second nozzle is then the load sensing pressure of the first consumer. Thus, a magnitude of the regulating pressure is between the load pressure of the first consumer and the load sensing pressure thereof. In comparison with an embodiment of the control arrangement with just one nozzle, the regulating pressure is thus higher, for which reason the spring force of the regulating spring can be smaller to ensure that, according to the disclosure, a pressure equivalent of the spring force together with the regulating pressure is greater overall than the pump pressure in normal operation. A lower spring force leads to a smaller spring, which requires a small installation space and is simple to install owing to the lower spring forces.

The pressure divider is preferably designed in such a way that, in the regulating mode of the pressure reducing valve, in which the first consumer is not the consumer with the highest load pressure, the pressure drop across the nozzles between a pressure tap of the control line downstream of the nozzles and an inlet of the pressure limiting valve, together with the pressure equivalent of the regulating spring, is greater than the pressure difference between the pump pressure and the highest load sensing pressure of the consumers, i.e. the pump $\Delta p$. This has the effect that a load pressure of the first consumer does not rise, despite a load pressure of the second consumer exceeding the load pressure of the first consumer.

It is advantageous if the pressure reducing valve is designed simply as a pressure compensator, which generally has large regulating springs, e.g. with a pressure equivalent of a spring force of 15 bar.

The control arrangement is preferably used to control a hydraulic drilling unit, in which case the first consumer is then a hammering device, which is dependent on the prevailing pressure, and the second consumer is a feed device.

A control valve, in particular in the form of a logic valve, is simply provided in the pressure medium flow path between the pressure reducing valve and the first consumer to connect and disconnect the first consumer.

BRIEF DESCRIPTION OF THE DRAWINGS

Preferred embodiments of the disclosure are explained in greater detail below by means of drawings, in which.

DETAILED DESCRIPTION

Figure 1:
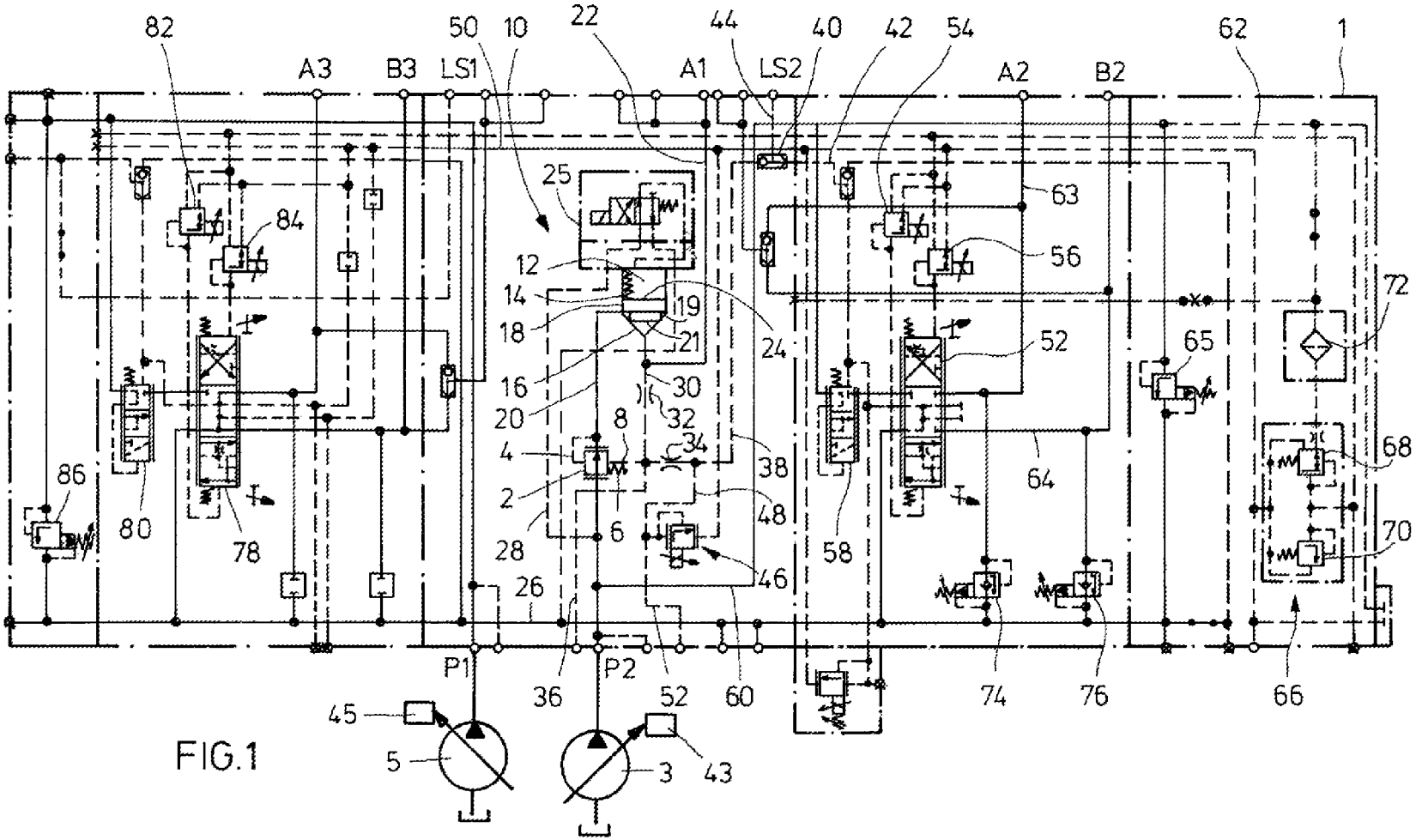
FIG. 1 shows a hydraulic circuit diagram of a hydraulic load sensing control arrangement according to the disclosure in accordance with a first embodiment.

FIG. 1 shows a control block 1 with a hydraulic load sensing control arrangement for a first hydraulic consumer, which is connected to a consumer port A1, a second hydraulic consumer, which is connected to consumer ports A2 and B2, and a third hydraulic consumer, which is connected to consumer ports A3 and B3. Here, the consumers, which are not shown in FIG. 1, are part of a hydraulic drilling unit or of a drill, wherein the first consumer is a hammering device or an impact device, the second consumer is a feed device and the third consumer is a rotation device for the drilling unit. The first and second consumers are supplied with pressure medium by a hydraulic pump 3 in the form of a variable displacement pump, which can be connected to pump port P2 of the control block 1. A separate hydraulic pump 5 in the form of a variable displacement pump, which is connected to pump port P1 of the control block 1, is provided for the third hydraulic consumer.

A pressure reducing valve in the form of a pressure compensator 2 is arranged in the pressure medium flow path between pump port P2 and the first consumer port A1. A valve spool of the pressure compensator 2 is acted upon in the closing direction thereof by a pressure which is tapped downstream of the pressure compensator 2 by means of a control line 4. In its opening direction, the valve spool of the pressure compensator 2 is subjected to a regulating pressure by a spring force of a regulating spring 6 and by a regulating pressure from a regulating line 8, which is explained in detail below.

To connect and disconnect the first consumer connected to consumer port A1, a logic valve 10 is arranged downstream of the pressure compensator 2 and of the tapping point of the control line 4. This valve has a sea valve 12 with a valve body 18 preloaded onto a valve seat 16 by means of a spring force of a valve spring 14. This valve body is of stepped design, and can be placed on the valve seat 16 by its step portion having a small diameter. By virtue of the stepped design of the valve body 18, said body has an annular surface 19, which faces in the direction of the valve seat 16 and, together with the step portion having a small diameter, delimits an annular space in the closed state of the seat valve 12. Connected to said annular space is a first pressure line 20, which forms a section of the pressure medium flow path between pump port P2 and the first consumer port A1 and is provided between the pressure compensator 2 and the seat valve 12. That end face 21 of the step portion having a smaller diameter which faces the valve seat 16 delimits a pressure space, to which is connected a second pressure line 22, which forms the other section of the pressure medium flow path and opens into the first consumer port A1. The annular surface 19 and end face 21 both face in the direction of the valve seat 16. A pressure surface 24 of the valve body 18, said surface facing away from the annular surface 19 and end face 21, delimits a spring space. The valve spring 14 is arranged in said spring space, wherein the spring space can be connected by means of a 2/2-way valve 25 to pump port P2 via a pressure line 28 and thus to the variable displacement pump connected thereto or to a tank line 26 for pressure relief of the spring space. A valve spool of the directional control valve 25 is spring loaded into its home position, in which the spring space of the seat valve 12 is connected to pump port P2 via pressure line 28, and can be moved by means of an electromagnetic actuator into a position in which the spring space is then connected to the tank line 26. In an unactuated state of the directional control valve 25, the spring space is thus connected to the variable displacement pump, as a result of which the valve body 18 rests on the valve seat 16 and the first consumer is disconnected.

A load pressure of the first consumer is tapped from the second pressure line 22 via a control line 30 downstream of the logic valve 10. A pressure divider with a first nozzle 32 and a second nozzle 34 arranged downstream of nozzle 32 is provided in said control line. In the pressure medium flow path between the nozzles 32 and 34, the regulating line 8 branches off to apply the regulating pressure to the valve spool of the pressure compensator 2. A measuring line 36 for measuring the regulating pressure furthermore branches off between nozzles 32 and 34. Connected to the control line 30 downstream of the second nozzle 34 is a load sensing indicator line 38, which in turn is connected to one inlet port of a shuttle valve 40. A load sensing indicator line 42 of the second hydraulic consumer, which is connected to the second consumer ports A2 and B2, is then connected to a second inlet port of the shuttle valve 40, with the result that the respectively highest load sensing pressure of the first and second hydraulic consumers is then indicated via the shuttle valve 40 to a load sensing regulating system (not shown in FIG. 1) for the variable displacement pump connected to pump port P2. For this purpose, the shuttle valve 40 is connected on the output side to a load sensing line 44, which opens into a load sensing port $LS_2$ which, in turn, is connected to the load sensing regulating system of the variable displacement pump. Connected to the load sensing indicator line 38 of the first consumer via a connection line 48 is a pilot valve 46 in the form of a pressure limiting valve 46, which can be adjusted proportionately by means of an electromagnetic actuator and which limits a load sensing pressure in the load sensing indicator line, wherein the pilot valve 46 is electromagnetically actuable. At a predetermined pressure, this valve then opens a pressure medium connection to a leakage line 50. Branching off from the connection line 48 is a further measuring line 52, which is used to measure the load sensing pressure in the load sensing indicator line 48.

The second hydraulic consumer, which is connected to the second consumer ports A2, B2, is controlled by means of a directional control valve 52, the control piston of which can be adjusted by means of pressure reducing valves 54, 56. Directional control valve 52 is assigned a pressure compensator 58, by means of which directional control valve 52 can be connected to pump port P2, wherein the connection is provided by a pressure line 60, which branches off from the pressure medium flow path between pump port P2 and the pressure compensator 2. A control system of this kind for controlling the second hydraulic consumer is sufficiently well known from the prior art and is disclosed in the publication DE 10 2008 008 101 A1, for example, and therefore only the elements essential to the disclosure will be described below and attention is drawn to said publication for further information.

Pressure reducing valve 54 connects a control surface of the control piston of directional control valve 52 either to the leakage line 50 or to a control line 62. The other control surface of the control piston can likewise be connected by means of pressure reducing valve 56 either to the leakage line 50 or to control line 62. The load sensing indicator line 42 of the second hydraulic consumer can be connected via directional control valve 52 and a nozzle to a pressure line 63 connected to the second consumer port A2 or to a pressure line 64 connected to the second consumer port B2 in order to tap a load sensing pressure dependent on the load pressure of the second consumer. Thus, via the shuttle valve 40, the load sensing pressure of either the first or second hydraulic consumer is indicated to the load sensing regulating system of the variable displacement pump via the second load sensing port $LS_2$, depending on which pressure is higher.

Connected to the pressure line 60 for supplying pressure medium to the second hydraulic consumer is a pressure limiting valve 65, by means of which a pressure medium connection to the tank line 26 can be opened. Also connected to pressure line 60 is a control oil supply 66, which has a pressure reducing valve 68, a pressure limiting valve 70 and a filter 72, which is connected to control line 62.

Pressure lines 63 and 64 are each connected to the tank line 26 by means of a pressure limiting and anti-cavitation valve 74 or 76.

The third hydraulic consumer, which is connected to consumer ports A3 and B3, is supplied independently of the variable displacement pump of pump port P2 by the further variable displacement pump, which is connected to pump port P1. A load sensing pressure dependent on the load pressure thereof is indicated to a load sensing regulating system, connected to a load sensing port $LS_1$, of the variable displacement pump connected to pump port P1. A directional control valve 78, a pressure compensator 80 and two pressure reducing valves 82, 84 controlling the control piston of directional control valve 78 are assigned to consumer ports A3 and B3 in a manner corresponding to the second consumer. Moreover, a pressure limiting valve 86 connected to pump port P1 is provided.

The mode of operation of the hydraulic load sensing control arrangement will be explained below with reference to the first and second hydraulic consumers since these are supplied by a common variable displacement pump connected to pump port P2 and the load sensing regulation of this variable displacement pump depends on the load pressure of these consumers.

By means of the highest load sensing pressure indicated to the load sensing regulating system, the variable displacement pump connected to pump port P2 is adjusted in such a way that a pump pressure is above said indicated load sensing pressure by a certain pressure difference Δp or pump Δp. The higher the pump Δp, the more dynamic is the response of the control arrangement for the first and second consumers. A pump Δp of about 30 bar has proven particularly advantageous. In normal operation of the hydraulic control arrangement 1, the first consumer connected to the first consumer port A1 is the consumer with the highest load. Since the pressure losses of the control arrangement 1 are supposed to be low in normal operation, the pressure compensator 2 is fully open according to the disclosure. In contrast to the prior art explained at the outset, the valve spool of the pressure compensator 2 is not subjected to the load sensing pressure dependent on the load pressure of the first consumer for this purpose but is subjected to a regulating pressure, which is tapped between nozzles 32 and 34 and is thus between the load pressure and the load sensing pressure. For example, the load pressure of the first consumer in the second pressure line 22 is about 230 bar and the load sensing pressure of the load sensing indicator line 8 is about 200 bar, wherein this pressure should be limited to about 200 bar by pressure limiting valve 46. By means of the nozzles 32 and 34, the load pressure is then reduced by about 30 bar to the load sensing pressure. It is assumed here that the first nozzle 32 reduces the load pressure by about 14 bar to the regulating pressure, which is then about 216 bar, and the second nozzle 34 then reduces the regulating pressure by about 16 bar to the load sensing pressure. In general, pressure compensators 2 have regulating springs with a high spring force. It is assumed that a pressure equivalent of the spring force of the regulating spring 6 is about 15 bar since pressure compensators generally have regulating springs with a high spring force, as a result of which a pressure of about 231 bar acts in the opening direction of the valve spool of the pressure compensator 2. By means of the load sensing regulating system, to which the load sensing pressure of 200 bar of the indicator line 38 is indicated, a pressure of 230 bar is set at the variable displacement pump connected to pump port P2. This pressure is below the pressure acting in the opening direction on the valve spool of the pressure compensator 2, which is the sum of the 216 bar regulating pressure and the 15 bar pressure equivalent of the spring force of the regulating spring 6, for which reason the pressure compensator 2 is completely open. The pressures acting in the opening direction on the valve spool of the pressure compensator 2 are only slightly greater than the pressures acting in the closing direction.

If the control arrangement 1 is not operated in the normal mode, the second consumer, which is connected to consumer ports A2 and B2, has the higher load pressure, which is 260 bar, for example. The load sensing pressure thereof, which is dependent on the load pressure, is indicated via load sensing indicator line and the shuttle valve 40 to the load sensing regulating system of the variable displacement pump connected to pump port P2, being about 30 bar below the load pressure, with the result that the load sensing pressure is about 230 bar. Together with the pump Δp of 30 bar, a pump pressure of 260 bar is established at the variable displacement pump. This is counteracted at the pressure compensator 2 by the regulating pressure at a level of 216 bar and the pressure equivalent of the regulating spring 6 at a level of 15 bar, for which reason the pressure across the pressure compensator 2 is reduced to 231 bar in the regulating mode of the pressure compensator 2.

Owing to the control arrangement 1 according to the disclosure, the pressure compensator 2 is thus fully open when the first hydraulic consumer, to which this pressure compensator 2 is assigned, is the consumer with the highest load pressure. The pressure compensator 2 enters its regulating mode only when the first consumer is no longer the consumer with the highest load pressure.

Figure 2:
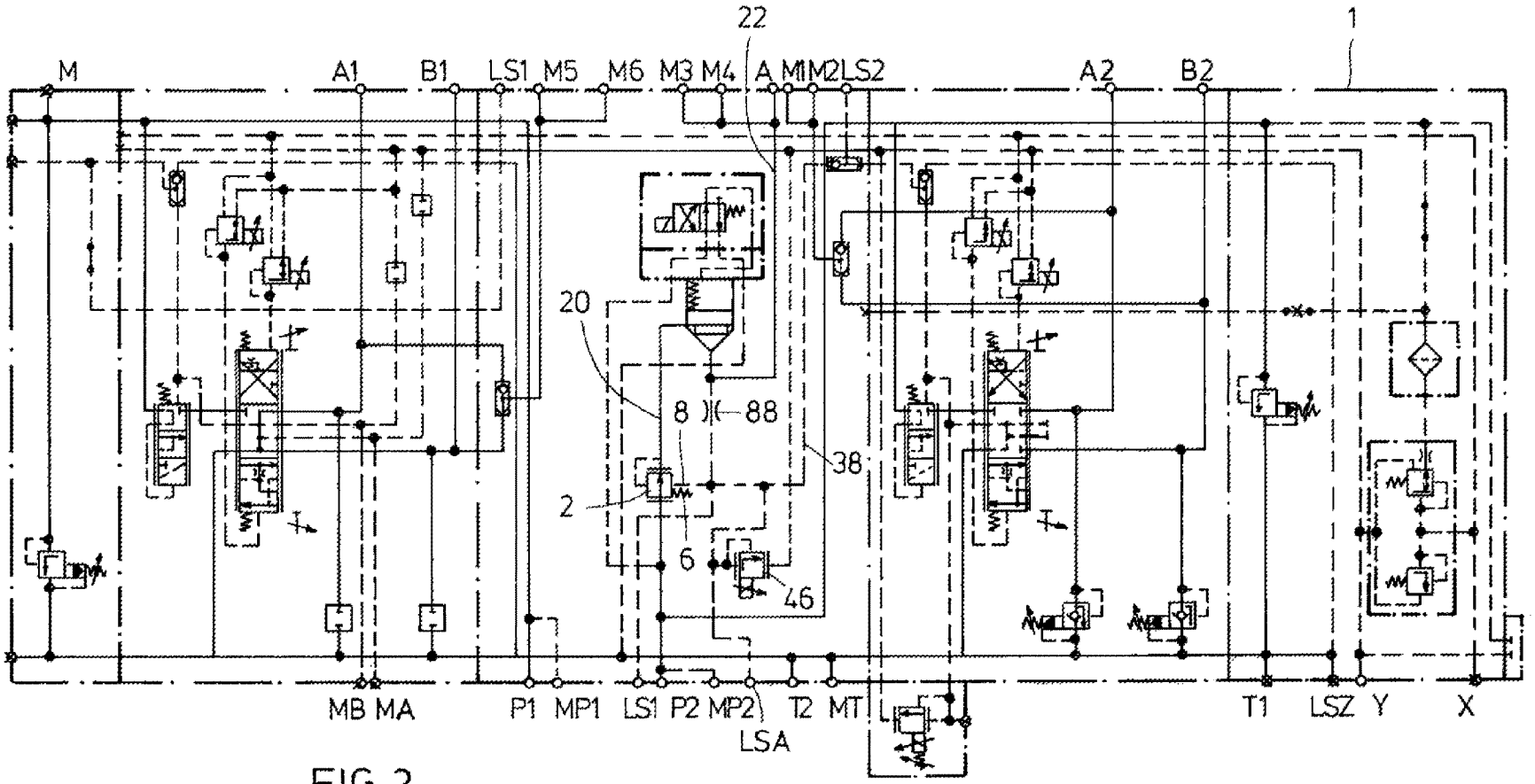
FIG. 2 shows a hydraulic circuit diagram of a hydraulic load sensing control arrangement according to the disclosure in accordance with a second embodiment.

In FIG. 2, in contrast to FIG. 1, the control arrangement 1 has only one nozzle 88 between the second pressure line 22 and load sensing indicator line 38. The regulating line 8 taps the regulating pressure downstream of the nozzle 88, for which reason the regulating pressure in this case corresponds to the load sensing pressure in the load sensing indicator line 38. If the same pressure values as in the first illustrative embodiment in FIG. 1 are assumed, the regulating pressure in the regulating line 8 is lower and is 200 bar. To ensure that the valve spool of the pressure compensator 2 is now fully open in normal operation, a pressure equivalent of the spring force of the valve spring 6 of the pressure compensator 2 is higher than in the first illustrative embodiment and is, for example, 31 bar, for which reason approximately 31 bar in total then act on the valve spool of the pressure compensator 2 in the opening direction in a manner corresponding to the first illustrative embodiment 1.

A hydraulic load sensing control arrangement for a first and a second hydraulic consumer is disclosed. In this arrangement, a variable displacement pump is provided with a load sensing regulating system. The respectively highest load sensing pressure of the consumers is indicated to the load sensing regulating system. In normal operation, the first consumer has the highest load pressure and thus the highest load sensing pressure, which is dependent on the load pressure. A pressure reducing valve is furthermore provided, which is arranged in the pressure medium flow path between the variable displacement pump and the first consumer. A valve spool of said pressure reducing valve is subjected in the opening direction thereof to a spring force of a regulating spring and to a regulating pressure dependent on the load pressure of the first consumer and is subjected in the closing direction thereof to the pressure directly downstream of the pressure reducing valve. To ensure that the valve spool of the pressure reducing valve is advantageously fully open in normal operation, a pressure equivalent of the spring force of the regulating spring and the regulating pressure are greater than a pump pressure of the variable displacement pump.

LIST OF REFERENCE SIGNS

1 control block
2 pressure compensator
4 control line
6 regulating spring
8 regulating line
10 logic valve
12 seat valve
14 valve spring
16 valve seat
18 valve body
19 annular surface
20 first pressure line
21 end face
22 second pressure line
24 directional control valve
26 tank line
28 pressure line
30 control line
32 nozzle
34 nozzle
36 measuring line
38 load sensing indicator line
40 shuttle valve
42 load sensing indicator line
44 load sensing line
46 pilot valve/pressure limiting valve
48 connection
50 leakage line
52 directional control valve
54 pressure reducing valve
56 pressure reducing valve
58 pressure compensator
60 pressure line
62 control line
63 pressure line
64 pressure line
65 pressure limiting valve
66 control oil supply
68 pressure reducing valve
70 pressure limiting valve
72 filter
74 pressure limiting and anti-cavitation valve
76 pressure limiting and anti-cavitation valve
78 directional control valve
80 pressure compensator
82 pressure reducing valve
84 pressure reducing valve
86 pressure limiting valve
88 nozzle
A1 first consumer port
A2, B2 second consumer ports
A3, B3 third consumer ports
P1, P2 pump port
LS1, LS2 load sensing port

The invention claimed is:

1. A hydraulic load sensing control arrangement for a first and second hydraulic consumer, comprising:

a hydraulic pump configured to supply the first and second consumers and including a load sensing regulating system to which a respectively highest load sensing pressure of the consumers, which is dependent on a load pressure, is indicated, the first consumer being configured to have the highest load pressure in normal operation of the control arrangement;

a pressure reducing valve located in a pressure medium flow path between the hydraulic pump and the first consumer, said pressure reducing valve having a valve spool configured to be subjected (i) in a closing direction to a pressure downstream of the pressure reducing valve and (ii) in an opening direction to a regulating pressure dependent on the load pressure of the first consumer and to a spring force of a regulating spring; and a control line having a first nozzle, wherein:

in normal operation, a pressure equivalent of the spring force together with the regulating pressure is greater than a pump pressure;

the regulating pressure is tapped from the pressure medium flow path between the pressure reducing valve and the first consumer via the control line;

the control line includes a second nozzle located downstream of the first nozzle;

the first and second nozzles form a pressure divider;

the regulating pressure for the pressure reducing valve is tapped in the pressure medium flow path between the first and second nozzles; and a pressure downstream of the second nozzle is the load sensing pressure of the first consumer.

2. The control arrangement as claimed in claim 1, wherein the pressure divider is designed in such a way that, in a regulating mode of the pressure reducing valve, a pressure drop across the first and second nozzles between a pressure tap of a load sensing indicator line and an inlet of the pressure limiting valve, together with a pressure equivalent of the spring force of the regulating spring, is greater than a pressure difference between the pump pressure and the highest load sensing pressure of the consumers.

3. The control arrangement as claimed in claim 1, wherein the load sensing pressure of the first consumer is limited by a pressure limiting valve.

4. The control arrangement as claimed in claim 1, wherein the pressure reducing valve is a pressure compensator.

5. The control arrangement as claimed in claim 1, wherein:

said control arrangement is configured to control a hydraulic drilling unit; and the first consumer is a hydraulic hammering device and the second consumer is a hydraulic feed device.

6. The control arrangement as claimed in claim 1, further comprising:

a control valve located in the pressure medium flow path between the pressure reducing valve and the first consumer and configured to open and close a pressure medium connection between the pressure reducing valve and the first consumer.

* * * * *